US007819673B2

(12) United States Patent
Hirashima

(10) Patent No.: US 7,819,673 B2
(45) Date of Patent: Oct. 26, 2010

(54) STACKING CONNECTOR AND ELECTRONIC DEVICE

(75) Inventor: Masaya Hirashima, Ome (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 0 days.

(21) Appl. No.: 12/549,809

(22) Filed: Aug. 28, 2009

(65) Prior Publication Data

US 2010/0112830 A1 May 6, 2010

(30) Foreign Application Priority Data

Oct. 30, 2008 (JP) ..... 2008-280286

(51) Int. Cl.
*H01R 13/24* (2006.01)

(52) U.S. Cl. ..... 439/74

(58) Field of Classification Search ..... 439/700, 439/74

See application file for complete search history.

(56) References Cited

U.S. PATENT DOCUMENTS

| | | | | |
|---|---|---|---|---|
| 5,181,855 | A * | 1/1993 | Mosquera et al. | 439/74 |
| 5,334,076 | A * | 8/1994 | Shinozuka | 446/456 |
| 5,382,168 | A | 1/1995 | Azuma et al. | |
| 5,444,601 | A * | 8/1995 | Honda et al. | 361/679.32 |
| 6,340,320 | B1 * | 1/2002 | Ogawa | 439/824 |
| 6,350,155 | B1 * | 2/2002 | Mullinger-Bausch et al. | 439/675 |
| 6,464,511 | B1 * | 10/2002 | Watanabe et al. | 439/66 |
| 6,506,082 | B1 * | 1/2003 | Meek et al. | 439/700 |
| 6,663,439 | B2 * | 12/2003 | Henry et al. | 439/700 |
| 6,776,668 | B1 * | 8/2004 | Scyoc et al. | 439/700 |
| 6,878,016 | B2 * | 4/2005 | Wulff et al. | 439/700 |
| 7,070,458 | B2 * | 7/2006 | Axenbock et al. | 439/700 |
| 7,503,773 | B2 * | 3/2009 | Tokunaga | 439/74 |

FOREIGN PATENT DOCUMENTS

| | | |
|---|---|---|
| JP | S63-266787 | 11/1988 |
| JP | H04-181671 | 6/1992 |
| JP | H06-168766 | 6/1994 |
| JP | 2003-086271 A | 3/2003 |
| JP | 2005-190815 A | 7/2005 |

OTHER PUBLICATIONS

Explanation of Non-English Language References.

* cited by examiner

*Primary Examiner*—Truc T Nguyen
(74) *Attorney, Agent, or Firm*—Knobbe, Martens, Olson & Bear LLP

(57) ABSTRACT

According to one embodiment, a stacking connector includes a first connector and a second connector plugged into the first connector. The first connector includes a first terminal expandable/compatible in a plug-in direction in which the second connector is plugged, and a mold main body surrounding the first terminal. The first terminal includes a first portion and a second portion including a first overlapping portion movable by slide with respect to the first portion, which partially overlaps with the first portion in the plug-in direction and is brought into direct contact with the second connector. The first portion and the second portion are electrically connected to each other by at least two sections.

4 Claims, 5 Drawing Sheets

STACKING CONNECTOR AND ELECTRONIC DEVICE

CROSS-REFERENCE TO RELATED APPLICATIONS

This application is based upon and claims the benefit of priority from Japanese Patent Application No. 2008-280286, filed Oct. 30, 2008, the entire contents of which are incorporated herein by reference.

BACKGROUND

1. Field

One embodiment of the present invention relates to a stacking connector used to connect printed circuit boards to each other and an electronic device includes such a stacking connector.

2. Description of the Related Art

For example, Jpn. Pat. Appln. KOKAI Publication No. 4-181671 discloses a connector including a height adjustment plate which can respond to a change in distance between printed circuit boards. This connector includes a connector main body having a connection terminal on its back, and a plurality of height adjusting plates each attachable and detachable with respect to the connector main body. These height adjusting plates have thicknesses different from each other. Each of the height adjusting plates has an insertion hole through which a connection terminal is put. The connection terminal is the so-called DIP type terminal and it is arranged through a substrate to which the connector main body is secured.

This connector is able to connect printed circuit boards to each other by changing the height adjusting plate even in the case where an interval between a pair of printed circuit boards to be connected differs from another pair of circuit boards.

Recent years, the so-called high-speed transmission type printed circuit boards, which can exchange signals at a high speed within circuits, are very popular. Further, as this type of circuit boards becoming popular, interface standards for the high-speed transmission such as High-Definition Multimedia Interface (HDMI) and Digital Visual Interface (DVI) have been introduced. Here, in order to connect such printed circuit boards to each other, connectors need to be employed as the conventional techniques. However, in the high-speed transmission of recent years, the problem of "stub", which has not been assumed for conventional types of connectors, becomes prominent. Especially, in the case of the connector discussed in Jpn. Pat. Appln. KOKAI Publication No. 4-181671, the portion of the DIP type terminal, which projects through the printed circuit board out to the opposite side becomes a stub. Due to this problem, the conventional connector cannot be employed as it is to connect high-speed transmission type printed circuit boards to each other, and it is susceptible to improvements.

BRIEF DESCRIPTION OF THE SEVERAL VIEWS OF THE DRAWINGS

A general architecture that implements the various feature of the invention will now be described with reference to the drawings. The drawings and the associated descriptions are provided to illustrate embodiments of the invention and not to limit the scope of the invention.

DETAILED DESCRIPTION

Various embodiments according to the invention will be described hereinafter with reference to the accompanying drawings. In general, according to one embodiment of the invention, a stacking connector includes a first connector and a second connector plugged into the first connector. The first connector includes a first terminal expandable/compatible in a plug-in direction D in which the second connector is plugged, and a mold main body surrounding the first terminal. The first terminal includes a first portion and a second portion including a first overlapping portion movable by slide with respect to the first portion, which partially overlaps with the first portion in the plug-in direction D and is brought into direct contact with the second connector. The first portion and the second portion are electrically connected to each other by at least two sections.

An electronic device according to the first embodiment of the present invention will now be described with reference to FIGS. 1 to 5.

Figure 1:
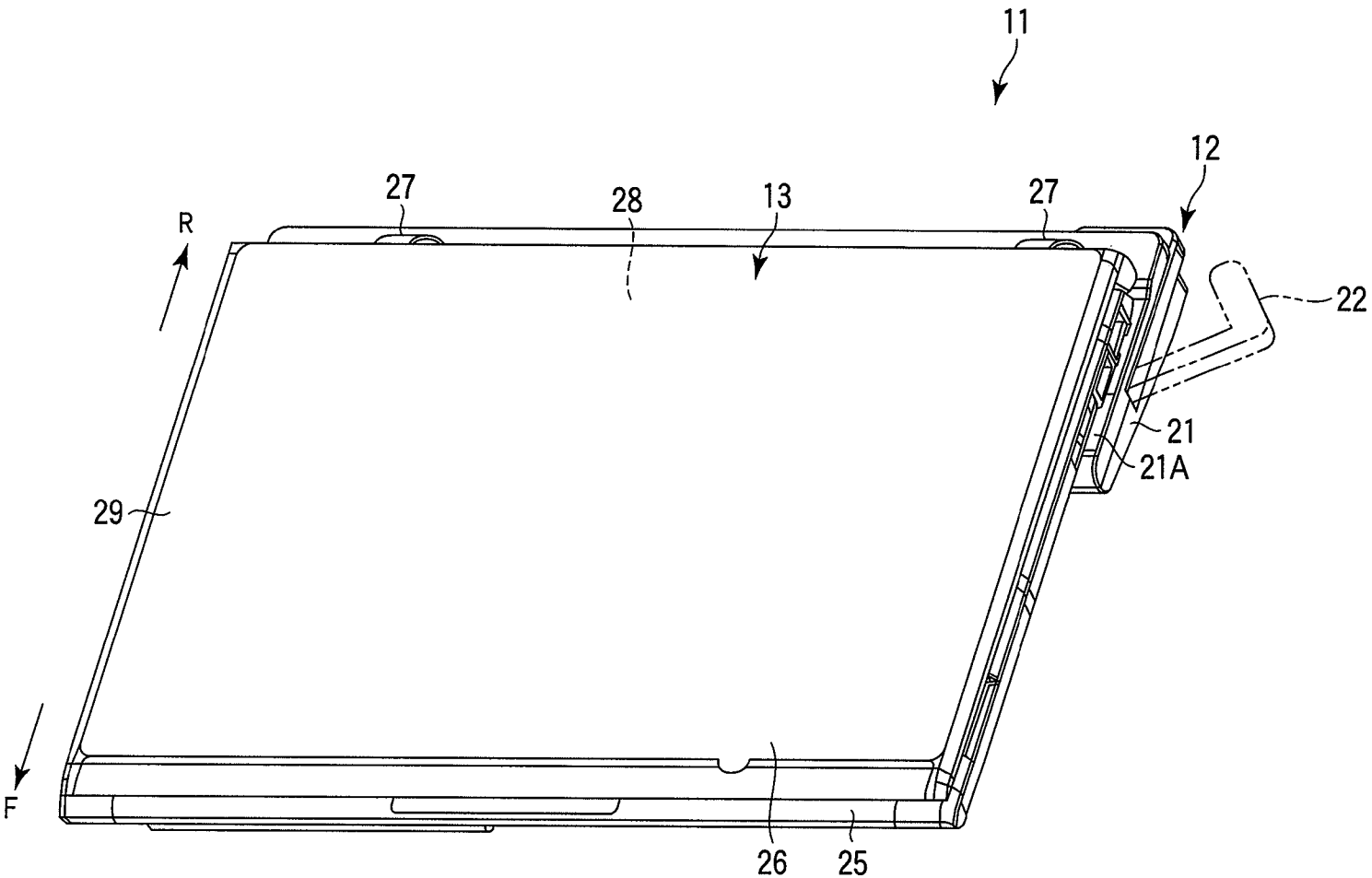
FIG. 1 is an exemplary perspective view showing an electronic device according to the first embodiment, in which a portable computer docks with a docking device.
Figure 3:
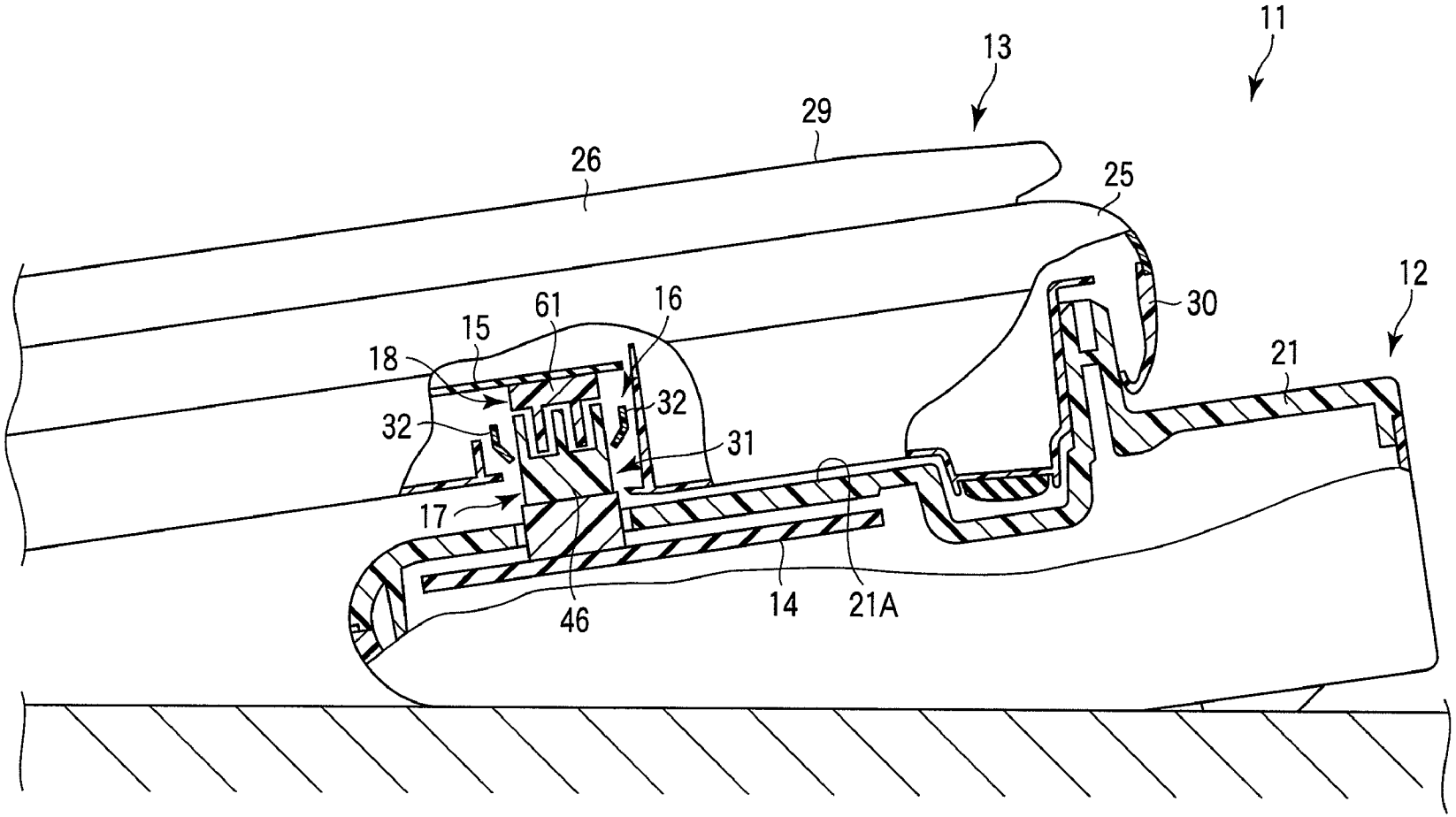
FIG. 3 is an exemplary cross sectional view of the portable computer shown in FIG. 1 sectioned along its vertical direction.

As shown in FIGS. 1 and 3, an electronic device 11 includes a data processing apparatus and a docking device 12 to which the data processing device is connected. As an example of the data processing device, a notebook portable computer 13 is employed in this embodiment. Further, the electronic device 11 includes a stacking connector 16 which connects the first printed circuit board 14 of the docking device 12 to the second printed circuit board 15 of the portable computer 13. The stacking connector 16 includes a first connector 17 contained in the docking device 12 and a second connector 18 contained in the portable computer 13. The details of this will be discussed later.

The docking device 12 is used to connect the portable computer 13 to external peripheral devices such as an external keyboard, a printer and an external monitor. The docking device 12 includes a case 21 formed of, for example, a synthetic resin into a flat box shape, a first printed circuit board 14 housed inside the case 21 and a first connector 17 mounted on one surface of the first printed circuit board 14. The case 21 includes a flat placement surface 21A in its upper surface, on which the portable computer 13 is placed. The docking device 12 includes a holding mechanism which holds the potable computer 13 by locking although it is not shown in the figure, and a release lever 22 which release the locking of the computer by the holding mechanism.

The portable computer 13 includes a main body unit 25, a display unit 26 and a hinge portion 27 provided between the main body unit 25 and the display unit 26. The hinge portion 27 supports the display unit 26 so as to be pivotable with respect to the main body unit 25. More specifically, the display unit 26 is pivotable between a first state where the display unit 26 is closed to the main body unit 25 as shown in FIG. 1, and a second state where the display unit 26 is opened from the main body unit 25, though it is omitted from the illustration.

The display unit 26 includes a liquid crystal display 28 and a cover 29 which covers the surrounding of the liquid crystal display 28.

Figure 2:
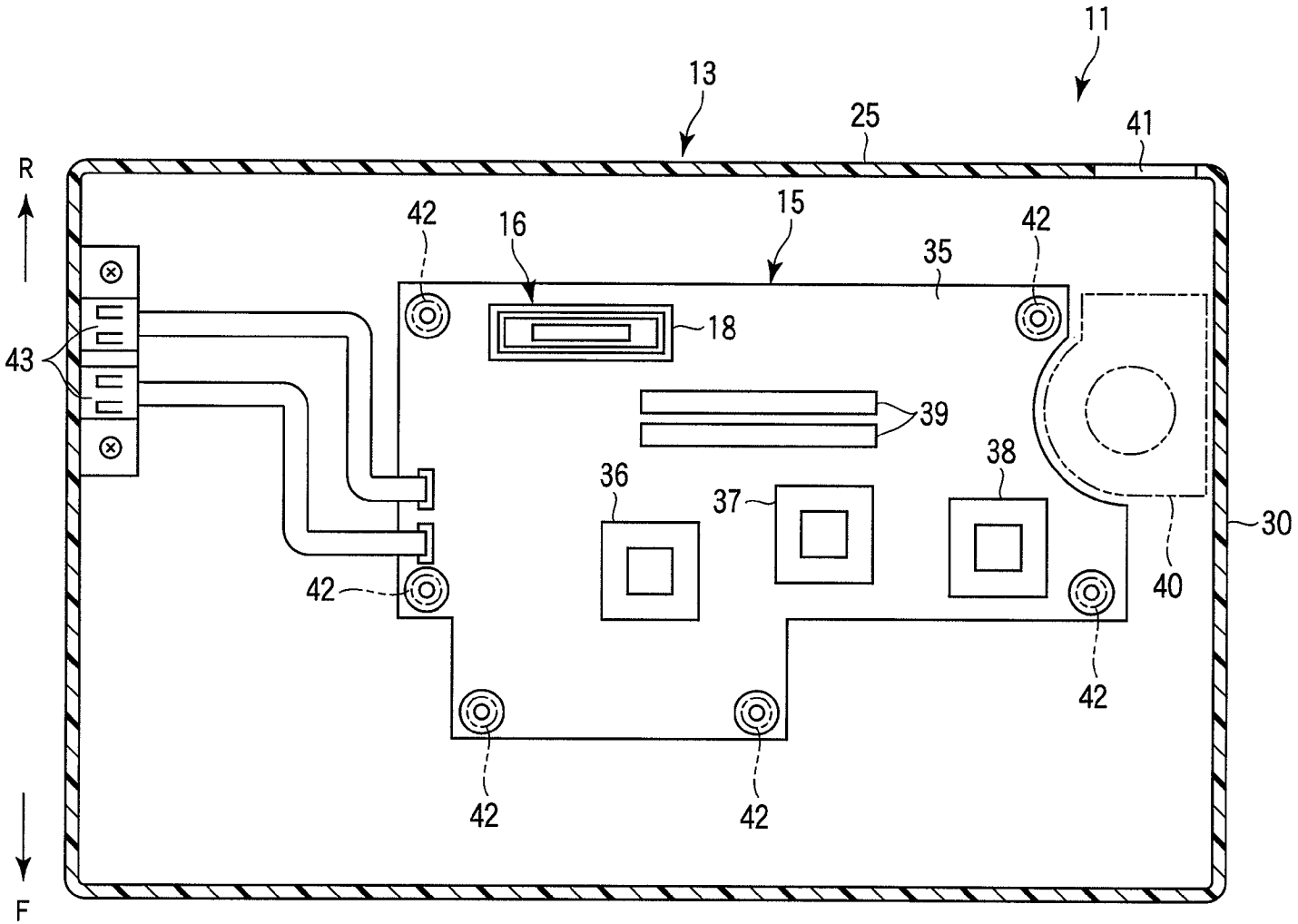
FIG. 2 is an exemplary cross sectional view showing an inside of the portable computer shown in FIG. 1 sectioned along its horizontal direction, viewed from below.

As shown in FIGS. 2 and 3, the main body unit 25 contains a housing 30, a keyboard provided on the upper surface of the housing 30, a second printed circuit board 15 housed inside the housing 30, a second connector 18 mounted on one surface of the second printed circuit board 15, an opening portion 31 made in the housing 30 such as to expose the second connector 18 to outside, a shutter 32 provided for the opening portion 31 to be openable/closable and a USB connector 43 for external connection. The housing 30 is made of, for example, a synthetic resin.

As shown in FIG. 3, the second printed circuit board 15 is provided to be independent from the first printed circuit board 14. As shown in FIG. 2, the second printed circuit board 15 includes a circuit board main body 35, a central processing unit (CPU) 36, which is a circuit part mounted to the circuit board main body 35, a north bridge 37, graphics chip 38 and random access memory (RAM) 39. In FIG. 2, an arrow F indicates a front direction of the portable computer 13, whereas an arrow R indicates a rear direction of the portable computer 13. Therefore, the main body unit 25 has the second connector 18 at a location close to the rear direction R.

The main body unit 25 further includes a fan unit 40 for cooling the CPU 36, north bridge 37 and graphics chip 38. Heat radiated from the CPU 36, north bridge 37 and graphics chip 38 is propagated via a heat pipe, which is not shown, to a portion near the fan unit 40, and then released by wind supplied from the fan unit 40 from a through hole 41 to the outside of the housing 30. The substrate main body 35 is secured to the housing 30 via a screw 42.

The stacking connector 16 is compatible with high-speed transmission interface standards including High-Definition Multimedia Interface (HDMI). It should be noted that the stacking connector 16 is not limited to such a type which is compatible with HDMI, but it is applicable to some other interface standards such as Digital Visual Interface (DVI), USB 2.0, D-sub and IEEE1394.

Figure 4:
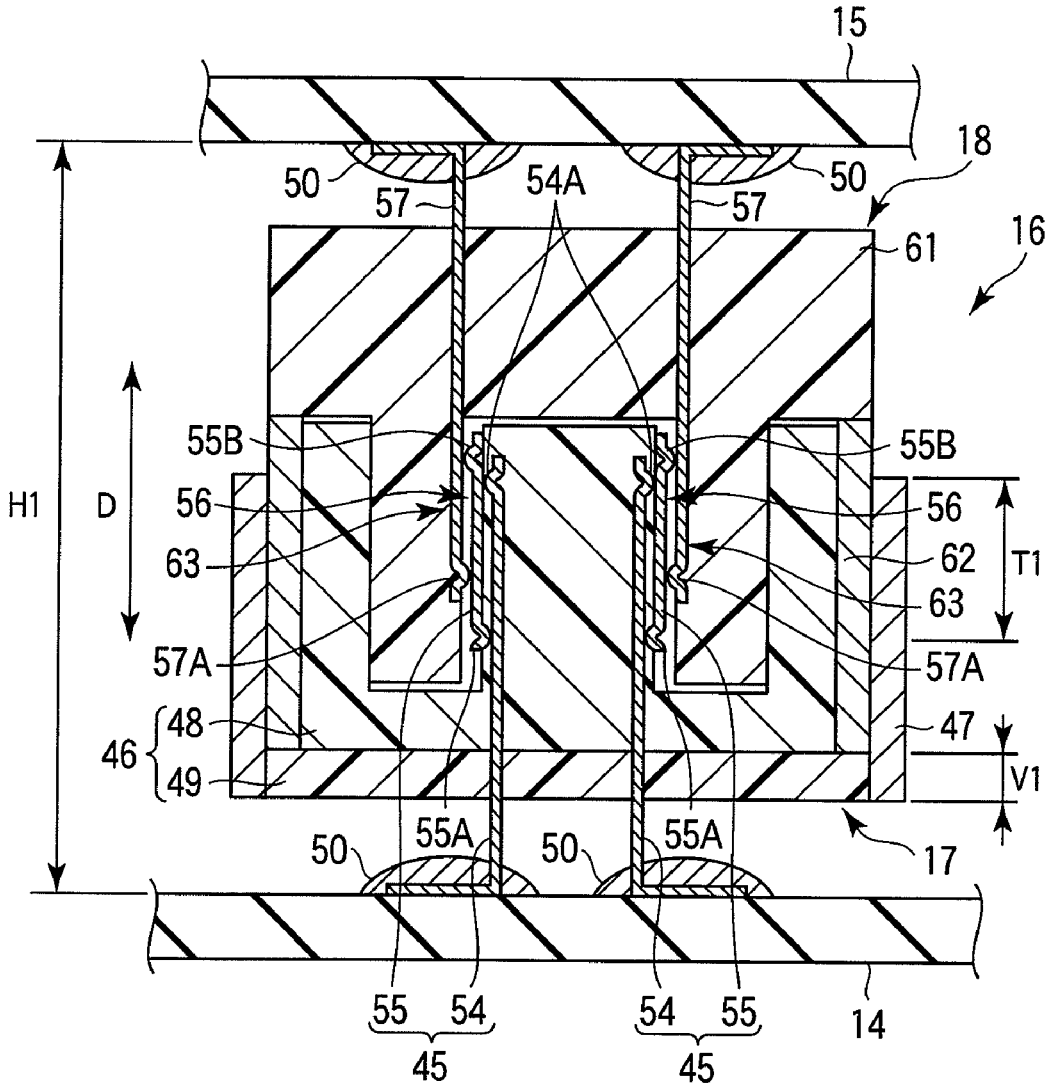
FIG. 4 is an exemplary enlarged cross sectional view of a stacking connector of the portable computer shown in FIG. 3 along its vertical direction.

The first connector 17 and the second connector 18 inserted to the first connector 17 are the so-called Surface Mount Technology (SMT) type connectors in which a terminal is not pierced through the printed circuit board. As shown in FIG. 4, the first connector 17 includes a plurality of first terminals 45 each having a flat plate shape, a first mold main body 46 which support the plurality of first terminals 45 such as to surround these terminals, and a first shell 47 which covers the first mold main body 46 such as to surround it. The first shell 47 is made of a metal material such as copper, phosphor bronze or stainless steel, and it serves to, for example, prevent the leakage of electromagnetic waves to the outside.

The first mold main body 46 is made of, for example, a synthetic resin. The first mold main body 46 includes a plug mold 48 containing a plug-shaped projection portion projecting towards the second connector 18 and a plate-like height adjustment mole 49 provided adjacent to the plug mold 48.

The first terminal 45 includes a first portion 54 connected by a solder 50 to the first printed circuit board 14 of the docking device 12 and a second portion 55 brought into direct contact with the second connector 18. The second portion 55 is slide-movable with regard to the first portion 54 and the first terminal 45 is extendible/contractible in an insertion direction D in which the second connector 18 is inserted.

The first potion 54 is provided on a bottom portion of the first connector 17. The first portion 54 has a first connection portion 54A which serves as a connection portion with respect to the second portion 55, at a distal end thereof, that is, the end portion on the side which faces the second portion 55. The first connection portion 54A is, for example, a projection portion formed in the first portion 54 by plastic process using a punch or the like, and it projects in, for example, a semi-sphere shape from the first portion 54 towards the second portion 55.

The second portion 55 includes a first overlapping portion 56 which partially overlaps with the first portion 54 in a plug-in direction D in which the second connector 18 is plugged. The second portion 55 has a second connection portion 55A at an end portion on the side which faces the first portion 54. The second portion 55 has a fourth connection portion 55B at an end portion on the side which faces the second terminal 57 of the second connector 18. The second connection portion 55A and the fourth connection portion 55B are, for example, projection portions each formed in the second portion 55 by plastic process using a punch or the like. The second connection portion 55A projects in, for example, a semi-sphere shape from the second portion 55 towards the first portion 54. The fourth connection portion 55B projects in, for example, a semi-sphere shape from the second portion 55 towards the second terminal 57.

The first connection portion 54A is provided at a position corresponding to one end of the first overlapping portion 56 in the plug-in direction D. The second connection portion 55A is provided at a position corresponding to another end located on an opposite side to the one end of the first overlapping portion 56 in the plug-in direction D. The first portion 54 and the second portion 55 of the first connector 17 are electrically connected to each other at least two sections, namely, the first connection portion 54A and the second connection portion 55A.

The first connector 18 includes a plurality of second terminals 57 each having a flat plate shape, a second mold main body 61 which support the plurality of second terminals 57 such as to surround the second terminals 57, and a second shell 62 which covers the second mold main body 61 such as to surround it. The second shell 62 is made of a metal material such as copper, phosphor bronze or stainless steel. The second mold main body 61 is formed of, for example, a synthetic resin.

The second terminals 57 are each connected by a solder 50 to the second printed circuit board 15 of the portable computer 13. While the second connector 18 being plugged in the first connector 17, each second terminal 57 is connected to the second portion 55 of the respective first terminal 45. The second terminal 57 a second overlapping portion 63 which partially overlaps with the second portion 55 in the plug-in direction D. The second terminal 57 has a third connection portion 57A at its distal end, which is an end portion on the side which faces the second portion 55. The third connection portion 57A is, for example, a projection portion formed in the second terminal 57 by plastic process using a punch or the like, and it projects in, for example, a semi-sphere shape from the second terminal 57 towards the second portion 55.

The third connection portion 57A is provided at a position corresponding to one end of the second overlapping portion 63 in the plug-in direction. The fourth connection portion 55B is provided at a position corresponding to another end located on an opposite side to the one end of the second overlapping portion 63 in the plug-in direction D. The second terminal 57 of the second connector 18 and the second portion 55 of the first connector 17 are electrically connected to each other at least two sections, namely, the third connection portion 57A and the fourth connection portion 55B.

Next, the function of the stacking connector 16 of this embodiment will now be described with reference to FIGS. 4 and 5. As shown in FIG. 4, in this embodiment, the distance between the first printed circuit board 14 and the second printed circuit board 15 is H1. In this state, the measurement T1 of the first overlapping portion 56 where the second portion 55 of the first terminal 45 overlaps with the first portion 54 is maintained to have a sufficient size. Further, the height adjustment mold 49 is made thin, and its thickness is V1.

Figure 5:
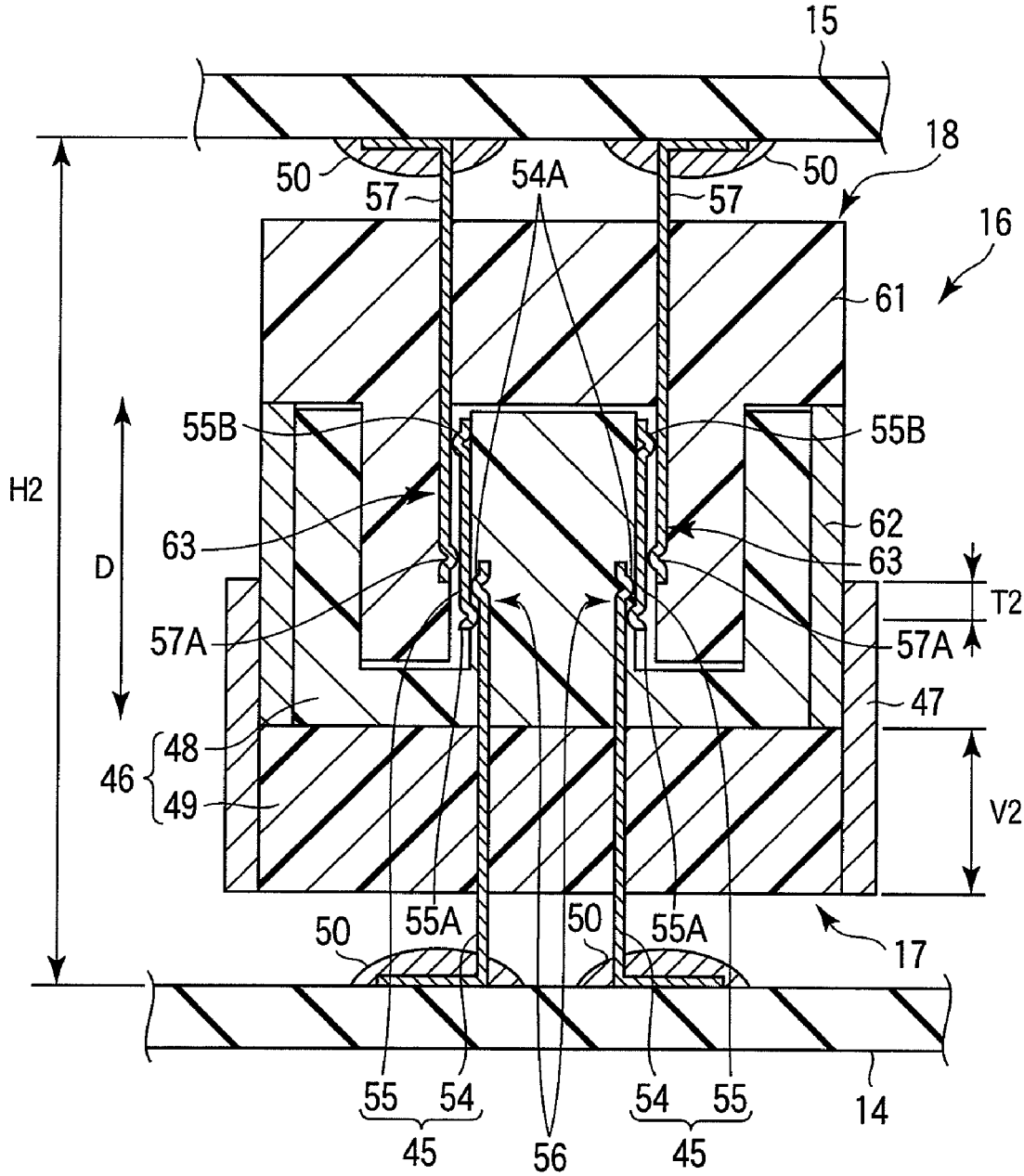
FIG. 5 is an exemplary cross sectional view showing a stacking connector sectioned along its vertical direction, in which the height (difference) between the first printed circuit board and the second printed circuit board is enlarged as compared to that of the stacking connector shown in FIG. 4.

Suppose that there is a change of designing in the electronic device 11, and for example, the distance between the first printed circuit board 14 and the second printed circuit board 15 is changed from H1 to H2, as shown in FIG. 5. In this case, the stacking connector 16 of this embodiment flexibly copes with such a change of designing by extending the first terminal 45. That is, in this state, the measurement T2 of the first overlapping portion 56 where the second portion 55 of the first terminal 45 overlaps with the first portion 54 becomes smaller than T1.

On the other hand, the plug mold 48 and the first shell 47 of the first connector 17, and the second terminal 57, the second mold main body 61 and the second shell 62 of the second connector 18 can be used without any variation even after such a case where the distance between the first printed circuit board 14 and the second printed circuit board 15 is changed. The height adjustment mold 49 is replaced by from that having a thickness of V1 to that of V2 which is larger than V1. Thus, only by replacing the height adjustment hold 49, the present invention can cope with such a case where the distance between the first printed circuit board 14 and the second printed circuit board 15 is changed.

According to the first embodiment, the electronic device 11 includes the first printed circuit board 14, the second printed circuit board 15 independent from the first printed circuit board 14, and the stacking connector 16 which connects the first printed circuit board 14 and the second printed circuit board 15 to each other. The stacking connector 16 further includes the first connector 17 and the second connector 18 plugged into the first connector 17. The first connector 17 includes the first terminal 45 expandable/contractible in the plug-in direction D in which the second connector 18 is plugged, and the mold main body which surrounds the first terminal 45. The first terminal 45 includes the first portion 54 and the second portion 55 having the first overlapping portion 56 movable by slide with respect to the first portion 54, which partially overlaps with the first portion 54 in the plug-in direction D and is brought into direct contact with the second connector 18. The first portion 54 and the second portion 55 are electrically connected to each other by at least two sections, namely, the first connection portion 54A provided at one end of the first overlapping portion 56 in the plug-in direction D, and the second connection portion 55A provided at another end located on an opposite side to the one end of the first overlapping portion 56 in the plug-in direction D.

With this structure, the first terminal 45 includes the first portion 54 and the second portion 55 so as to be expandable/contractible; therefore it can flexibly cope with a change in the distance between the first printed circuit board 14 and the second printed circuit board 15. By this way, even in the case where the distance between the first printed circuit board 14 and the second printed circuit board 15 is changed, there rises no necessity to re-design the first terminal 45 and the mold main body. Thus, it is possible to prevent the occurrence of a huge expense which may be required for newly forming a metal mold tool for mold main body, and also the term for the change of designing can be shortened. Further, the first portion 54 and the second portion 55 are electrically connected to each other by both ends of the first overlapping portion 56. With this structure, the projecting portion from the first terminal 45 can be suppressed as much as possible. In this manner, the formation of a section which gives rise to a stub in high-speed transmission can be avoided, and thus the generation of noise can be prevented and the signal transmission efficiency can be improved.

Further, the first portion 54 includes the first connection portion 54A at an end located at a position facing the second portion 55, and the second portion 55 includes the second connection portion 55A at an end located at a position facing the first portion 54. With this structure, the electrical connection between the first portion 54 and the second portion 55 is secured by both ends of the first overlapping portion 56, and an expandable/contractible structure of the first terminal 45 as a whole can be easily achieved.

Further, the first connection portion 54A is a projecting portion which projects from the first portion 54 towards the second portion 55, and the second connection portion 55A is a projecting portion which projects from the second portion 55 towards the first portion 54. With this structure, the first connection portion 54A and the second connection portion 55A can be each formed of a simple structure.

In this case, the second connector 18 includes the second terminal 57 connected to the second portion 55 of the first terminal 45. The second terminal 57 includes the second overlapping portion 63 which partially overlaps with the second portion 55 in the plug-in direction D. The second terminal 57 and the second portion 55 are electrically connected to each other by at least two sections, namely, the third connection portion 57A provided at one end of the second overlapping portion 63 in the plug-in direction D, and the fourth connection portion 55B provided at another end located on an opposite side to the one end of the second overlapping portion 63 in the plug-in direction D.

With this structure, the second portion 55 of the first terminal 45 and the second terminal 57 are electrically connected to each other by both end portions of the second overlapping portion 63 via the third connection portion 57A and the fourth connection portion 55B. In this manner, it is possible to prevent the formation of a "stub" even in the connection portion between the second portion 55 and the second terminal 57. Therefore, the generation of noise, which occurs in high-speed transmission, can be further suppressed, and the signal can be transmitted efficiently.

Further, the first terminal 57 includes the third connection portion 57A at an end located at a position facing the second portion 55, and the second portion 55 includes the fourth connection portion 55B at an end located at a position facing the second terminal 57. With this structure, the electrical connection between two connectors which are plugged in and out, for example, the first connector 17 and the second connector 18 of this embodiment, by connection portions with both ends of the second overlapping portion 63 can be easily realized. In this manner, it is possible to prevent the formation of a "stub" in the connection portion between the first connector 17 and the second connector 18. Therefore, high-speed transmission of signals can be performed smoothly.

It should be noted that in this embodiment, the stacking connector 16 is used to connect the first printed circuit board 14 of the docking device 12 to the second printed circuit board 15 of the portable computer 13; but it is not limited to this. Alternatively, the stacking connector 16 may be used to connect together two printed circuit boards housed in the housing 30 of the portable computer 13.

The electronic device of the present invention can be applied not only to a portable computer, but to some other electronic devices including mobile telephones. Further, the electronic device of the present invention can be realized into various remodeled versions as long as the essence of the invention does not fall out of the scope.

While certain embodiments of the inventions have been described, these embodiments have been presented by way of example only, and are not intended to limit the scope of the inventions. Indeed, the novel methods and systems described herein may be embodied in a variety of other forms; furthermore, various omissions, substitutions and changes in the form of the methods and systems described herein may be made without departing from the spirit of the inventions. The accompanying claims and their equivalents are intended to cover such forms or modifications as would fall within the scope and spirit of the inventions.

What is claimed is:

1. A stacking connector comprising:

a first connector; and a second connector configured to be plugged into the first connector, wherein the first connector comprises a first terminal configured to expand in a plug-in direction in which the second connector is plugged, and a mold surrounding the first terminal, wherein the first terminal comprises a first portion and a second portion comprising a first overlapping portion configured to slide with respect to the first portion, partially overlapping with the first portion in the plug-in direction and directly connecting to the second connector, wherein the first portion and the second portion are connected to each other and configured to conduct electricity by at least two connection portions, a first connection portion being at a first end of the first overlapping portion in the plug-in direction and a second connection portion being at a second end on an opposite side to the first end of the first overlapping portion in the plug-in direction, wherein the first portion comprises the first connection portion at an end portion facing the second portion, and the second portion comprises the second connection portion at an end portion facing the first portion, wherein the first connection portion is projecting from the first portion towards the second portion, and the second connection portion is projecting from the second portion towards the first portion, and wherein the second connector comprises a second terminal connected to the second portion of the first terminal, the second terminal comprising a second overlapping portion partially overlapping with the second portion in the plug-in direction, and the second terminal and the second portion are connected to each other and are configured to conduct electricity at at least two connection portions, a third connection portion being at a first end of the second overlapping portion in the plug-in direction and a fourth connection portion being at a position corresponding to a second end on an opposite side to the first end of the second overlapping portion in the plug-in direction.

2. The stacking connector of claim 1, wherein the second terminal comprises the third connection portion at an end portion facing the second portion, and the second portion comprises the fourth connection portion at an end portion facing the second terminal.

3. An electronic device comprising:

a first printed circuit board;

a second printed circuit board independent from the first printed circuit board; and a stacking connector configured to connect between the first printed circuit board and the second printed circuit board;

the stacking connector comprising:

a first connector; and a second connector configured to be plugged into the first connector, wherein the first connector comprises a first terminal configured to expand in a plug-in direction in which the second connector is plugged, and a mold surrounding the first terminal, wherein the first terminal comprises a first portion and a second portion comprising a first overlapping portion configured to slide with respect to the first portion, partially overlapping with the first portion in the plug-in direction and is directly connecting to the second connector, wherein the first portion and the second portion are connected to each other and configured to conduct electricity by at least two connection portions, a first connection portion being at a first end of the first overlapping portion in the plug-in direction and a second connection portion being at a second end on an opposite side to the first end of the first overlapping portion in the plug-in direction, wherein the first portion comprises the first connection portion at an end portion facing the second portion, and the second portion includes the second connection portion at an end portion facing the first portion, wherein the first connection portion is projecting from the first portion towards the second portion, and the second connection portion is projecting from the second portion towards the first portion, and wherein the second connector comprises a second terminal connected to the second portion of the first terminal, the second terminal comprising a second overlapping portion partially overlapping with the second portion in the plug-in direction, and the second terminal and the second portion are connected to each other and are configured to conduct electricity at at least two connection portions, a third connection portion being at a first end of the second overlapping portion in the plug-in direction and a fourth connection portion being at a position corresponding to a second end located on an opposite side to the first end of the second overlapping portion in the plug-in direction.

4. The stacking connector of claim 3, wherein the second terminal comprises the third connection portion at an end portion facing the second portion, and the second portion comprises the fourth connection portion at an end portion facing the second terminal.

* * * * *